US007296855B1

(12) United States Patent
Link

(10) Patent No.: US 7,296,855 B1
(45) Date of Patent: Nov. 20, 2007

(54) CHAIR, IN PARTICULAR OFFICE CHAIR

(75) Inventor: Werner Link, Messstetten (DE)

(73) Assignee: Interstuhl Bueromoebel GmbH & Co., KG, Messstetten (DE)

( * ) Notice: Subject to any disclaimer, the term of this patent is extended or adjusted under 35 U.S.C. 154(b) by 0 days.

(21) Appl. No.: 11/627,160

(22) Filed: Jan. 25, 2007

(30) Foreign Application Priority Data

Jul. 7, 2006 (DE) ..... 10 2006 031 448

(51) Int. Cl.
*A47C 7/40* (2006.01)

(52) U.S. Cl. ..... 297/353; 297/411.36; 248/423; 403/325

(58) Field of Classification Search ..... 297/353, 297/410, 411.36; 248/161, 118, 405, 407, 248/423; 403/108, 109.3, 324, 325
See application file for complete search history.

(56) References Cited

U.S. PATENT DOCUMENTS 1,095,890 A * 5/1914 Knauer ..... 297/353
RE19,721 E * 10/1935 Genung ..... 297/411.21
3,215,470 A * 11/1965 Swenson et al. ..... 297/353
4,221,430 A * 9/1980 Frobose ..... 403/324
4,632,458 A * 12/1986 Brown et al. ..... 248/422
5,542,743 A * 8/1996 Olson et al. ..... 297/353
5,897,166 A * 4/1999 Tsai ..... 297/353
6,296,313 B1 * 10/2001 Wu ..... 297/411.35
6,616,236 B1 * 9/2003 Su ..... 248/118
2004/0061368 A1 4/2004 Lin

FOREIGN PATENT DOCUMENTS

DE 297 07 784 7/1997

* cited by examiner

*Primary Examiner*—Peter R. Brown
(74) *Attorney, Agent, or Firm*—Michael J. Striker

(57) ABSTRACT

A chair has a chair body, a rest, an adjusting mechanism for adjusting a height of the rest and including a securing element solidly connected to the chair body and having a free end with a slot, a threaded bolt extending through the slot and screwable into a thread in the rest, and a hand wheel to which the threaded bolt is rigidly connected, so that securing of the rest to the end portion of the securing element in clamping fashion is effected, a clamping sleeve has a throughbore through which the threaded bolt reaches in an assembled state and an end face with diameter greater than a width of the slot, a plurality of detent elements lockingly engageable by the end face of the clamping sleeve, wherein the clamping sleeve or the detent recesses have at least one oblique face, and a pressure-generating device builds up a pressure force between the hand wheel and the clamping sleeve and has at least one force component parallel to the longitudinal axis of the clamping sleeve.

22 Claims, 2 Drawing Sheets

CHAIR, IN PARTICULAR OFFICE CHAIR

CROSS-REFERENCE TO A RELATED APPLICATION

The invention described and claimed hereinbelow is also described in German Patent Application DE 10 2006 031 448.4-14 filed on Jul. 7, 2006. This German Patent Application, whose subject matter is incorporated here by reference, provides the basis for a claim of priority of invention under 35 U.S.C. 119(a)-(d).

BACKGROUND OF THE INVENTION

The present invention relates to an office chair. More particularly, it relates to a chair, having a chair body and a backrest and/or armrests, in which an adjusting mechanism for adjusting the height of the backrest and/or of the armrests in the direction of the vertical relative to the chair body is provided, which includes at least one securing element, which is solidly connected to the chair body on one end of the adjusting mechanism and which on its free end has a vertically or obliquely upward-extending end portion with a substantially vertically oriented oblong slot or guide slot, through which a threaded bolt, connected on one end rigidly to a handwheel, reaches that on the other end can be screwed into a thread in the backrest and/or into the armrest, as a result of which securing of the backrest and/or of the armrests to the end portion of the securing element is effected in clamping fashion.

Chairs of this kind, with backrests and optionally also armrests that are adjustable in height relative to the chair body, have long been known particularly in the field of office chairs. As a rule, such a chair has a very simple adjusting mechanism, by means of which, by firmly screwing the threaded bolt in a height position, selected by the user, along the oblong slot or guide slot, the backrest and/or an armrest can be firmly clamped in the desired vertical spacing from the chair body, in particular the seat, on the end portion of the applicable securing element.

This type of adjusting mechanism has proved itself over many decades, because on the one hand it is very uncomplicated and is inexpensive to produce and on the other it is simple to manipulate even without detailed explanations. However, a substantial disadvantage of such devices is that when the screwed connection is released by opening the screw fastening of the threaded bolt, the clamping connection between the backrest or the armrest and the securing element is immediately and uncontrollably released, causing the backrest and armrest to drop downward unless the user holds them firmly.

Adjusting the height can only be done ever with two hands, by holding the backrest or armrest that is to be adjusted in a desired position with one hand, and with the other hand, by turning the handwheel and thus screwing in the threaded bolt, a clamping connection is brought about, so that the part to be adjusted is fixed in the current height position. If the screwed connection is not strong enough, however, a clamping force may possibly not suffice to counteract gravity over time; then the part to be adjusted slips downward from the desired position or falls all the way down into the lowest possible position specified by the oblong slot or guide slot.

SUMMARY OF THE INVENTION

Accordingly, it is an object of the present invention to provide an office chair which avoids the disadvantages of the prior art.

More particularly, it is an object of the present invention is to design a chair, of the known type described above, with the simplest possible means, in such a way that adjusting the height of the backrest and armrests is simplified still further, and in particular, even one-handed operation of the adjusting device is made possible; the fixation of the part to be adjusted in the desired position should be assured even if the clamping connection between the corresponding part and the end portion of the securing element, because the threaded bolt has been screwed only weakly into place, is not strong enough to keep the backrest or the armrest in the selected position counter to gravity.

This object is attained in accordance with the invention in a surprisingly simple but effective way in that a clamping sleeve that has both a through bore, through which the threaded bolt reaches in the assembled state, and an end face, oriented toward the end portion of the securing element, is located between the handwheel and the end portion of the securing element, and the diameter of the end face in a direction perpendicular to the longitudinal axis of the clamping sleeve is greater than the width of the oblong slot or of the guide slot; along the oblong slot or the guide slot in the surface of the end portion toward the handwheel, a plurality of successive detent recesses are provided, which can be lockingly engaged by the end face of the clamping sleeve; either the end face of the clamping sleeve or the detent recesses of the end portion or both have one or more flat or curved oblique faces; and a pressure-generating device is provided, which in the assembled state, with the threaded bolt screwed in, builds up a pressure force between the handwheel and the clamping sleeve that includes at least one force component parallel to the longitudinal axis of the clamping sleeve.

When the threaded bolt is firmly screwed into the thread in the backrest or the armrest in a height position selected by the user, a direct clamping connection between the handwheel and the securing element, of the kind in the above-described known adjusting devices, is now no longer made. Instead, on the one hand clamping is created between the clamping sleeve and the end portion of the securing element, or more precisely between the end face, lockingly engaging one of the detent recesses, and the corresponding detent recess, and further clamping is also created on the other hand between the other end of the clamping sleeve and an inner face of the handwheel facing toward the clamping sleeve.

When the screwed connection between the threaded bolt and the thread in the backrest or the armrest is released, both clamping connections are now indeed again loosened or entirely undone. However, the force component, acting parallel to the longitudinal axis of the clamping sleeve, from the pressure-generating device has the effect that the clamping sleeve is still pressed with a certain contact pressure into the corresponding detent recess in the securing element, so that the backrest or armrest, via the threaded bolt, remains as before fixed in its height position on the securing element as long as the threaded bolt is not rotated too far out of the thread.

In order now to make an adjustment in height, the user in this nonclamping state merely has to exert a certain shear force in a direction transverse to the longitudinal axis of the clamping sleeve and with a component parallel to the orientation of the oblong slot or the guide slot in the end portion of the securing element, which is very easy to do with one hand by suitably pressing laterally on the handwheel, which transmits this shear force onward to the clamping sleeve via the threaded bolt. Because of the special design of the relative geometry of the surfaces of the clamping sleeve and the detent recess that are involved in the clamping connection, namely the above-described oblique faces, which according to the invention are provided either on the end face of the clamping sleeve or on the detent recesses or on both partners, the shear force introduced onto the clamping sleeve brings about a motion of the clamping sleeve that extends obliquely in the direction of the handwheel, and the clamping sleeve is thus pressed out of the detent recess, counter to the pressure force exerted by the pressure-generating device.

Any shear force that is still operative then causes a lateral offset of the clamping sleeve—together with the handwheel, threaded bolt, and backrest or armrest, along the oblong slot or guide slot as far as the next detent recess, into which the clamping sleeve then snaps with its end face because of the pressure force from the pressure-generating device, if the shear force is not being maintained up by the user. Otherwise, the entire combination will still move onward until the user is no longer exerting any shear force (or until the stop on the corresponding end of the oblong slot or guide slot is reached).

Thus the apparatus according to the invention not only allows user-friendly, one-handed adjustment of the height of the backrest or armrest but also, because of the form lock between the clamping sleeve and the detent recess in addition to the clamping connection, offers still further fixation of the corresponding part, even if the screwed connection of the threaded bolt is not firmly tightened, and thus offers effective protection against shifting or even against the part's inadvertently dropping downward.

A class of embodiments of the chair according to the invention which can be implemented extremely simply and inexpensively in mass production is distinguished in that the pressure-generating device includes a spring element.

In an advantageous refinement of these embodiments, the spring element includes an elastic portion, in particular a rubber buffer.

Alternatively or in addition, in very particularly preferred refinements of this class of embodiments, the spring element includes a compression spring, preferably a helical spring, of the kind that is available on the market at a negligibly low price as a mass-produced article—even one with very detailed specifications of the spring parameters and dimensions.

In practice, variations of this refinement have proven themselves in which the threaded bolt, in the assembled state, reaches through the compression spring, and the maximum outside diameter of the threaded bolt is less than or equal to the minimum inside diameter of the compression spring, so that the spring upon assembly can easily be slipped onto the threaded bolt; however, there should not be too much play between the slipped-on spring and the threaded bolt, so that the spring will not inadvertently slip downward again.

Refinements that are especially favorable in geometric terms are those in which the through bore of the clamping sleeve, on its end that in the assembled state is toward the handwheel, has a first portion with a bore diameter greater than or equal to the maximum outside diameter of the spring element and adjoining it a second portion with a bore diameter less than the outside diameter of the spring element. The first portion of the bore then forms a chamber for the spring element, which because of the lesser bore diameter of the second portion rests on that portion.

Instead of the simple and economical spring element, in other embodiments of the invention the pressure-generating device can include a compressed-air device, in particular a gas cartridge. However, combinations of a spring element and a compressed-air device are also conceivable.

An embodiment of the invention in which the through bore of the clamping sleeve, in a portion which in the assembled state does not directly adjoin the handwheel, has a continuous thread fitting the thread of the threaded bolt is very particularly preferred. Upon assembly, then—optionally after a spring element has been slipped onto the threaded bolt—the clamping sleeve is screwed onto the threaded bolt in captive fashion, or the threaded bolt is screwed through the clamping sleeve. This assures that in the further course of assembly, neither the spring element nor the clamping sleeve can slip down from the threaded bolt.

A refinement of this embodiment, in which in the through bore of the clamping sleeve, the portion having the continuous thread is adjoined by a further portion without a thread, which portion extends as far as the end face toward the end portion of the securing element and has a bore diameter greater than or equal to the maximum outside diameter of the threaded bolt, is also advantageous. Specifically, to attain the above-described effects, a thread needs to be cut over only a relatively short length on the bore axis of the clamping sleeve. If the threaded bolt is likewise provided with a thread over only a certain length on its end toward the face end, and if the threaded portion is adjoined by a thread-free portion of somewhat smaller outside diameter of the threaded bolt, and this unthreaded portion fits through the continuous thread of the clamping sleeve, then after the assembly of the combination the threaded bolt can very easily be displaced axially inside the clamping sleeve.

In especially preferred embodiments of the invention, the oblique faces on the end face of the clamping sleeve and/or the oblique faces on the detent recesses of the end portion have spherical shapes. However—as an alternative or in addition—conical embodiments of the oblique faces are also possible.

Embodiments in which the oblique faces on the end face of the clamping sleeve are adapted geometrically to the oblique faces on the detent recesses in the end portion of the securing element in such a way that when the end face of the clamping sleeve snaps into a detent recess, a form lock that is as perfect as possible is created; in other words a ball-like end face of the clamping sleeve together with spherical detent recesses with corresponding radii of curvature, or a conical end face together with corresponding conical detent recesses, is optimal.

However, pairings in which oblique faces are present on only one of the partners are also possible, while in the other partner cylindrical bores, for instance, in the case of the detent recesses or a cylindrical end face, in the case of the clamping sleeve, are provided.

What is important above all is that on the one hand, it is assured that the clamping sleeve will snap securely into the corresponding detent recess, and on the other, a relatively easy transverse motion past the "apex" between two adjacent detent recesses is made possible for the sake of the displacement.

This latter effect can be attained in embodiments of the invention very simply by providing that the detent recesses in the end portion of the securing element are located adjoining one another directly.

For the sake of stability and durability, in view of the not entirely negligible forces that can act on the partners of the combination, in preferred embodiments the clamping sleeve is manufactured from metal material. However, applications with plastic clamping sleeves are also conceivable, as long as the plastic has adequate strength and hardness.

A further embodiment of the chair of the invention provides that the securing element is angled and in particular includes an angled metal strip. This strip can be installed especially simply, on its end placed opposite the end portion having the oblong slot or guide slot, on the typically horizontally extending seat part of the chair.

Finally, a further embodiment of the invention is distinguished in that a covering element is provided between the handwheel and the securing element and is connected to the backrest or to one of the armrests and has a bore through which the clamping sleeve reaches in the assembled state. Thus after assembly, the securing element becomes invisible, which has aesthetic advantages for the chair.

Further characteristics and advantages of the invention will become apparent from the ensuing detailed description of exemplary embodiments of the invention in conjunction with the drawing figures, which show details essential to the invention, and from the claims. The individual characteristics may each be realized individually or severally in arbitrary combinations, in variants of the invention.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
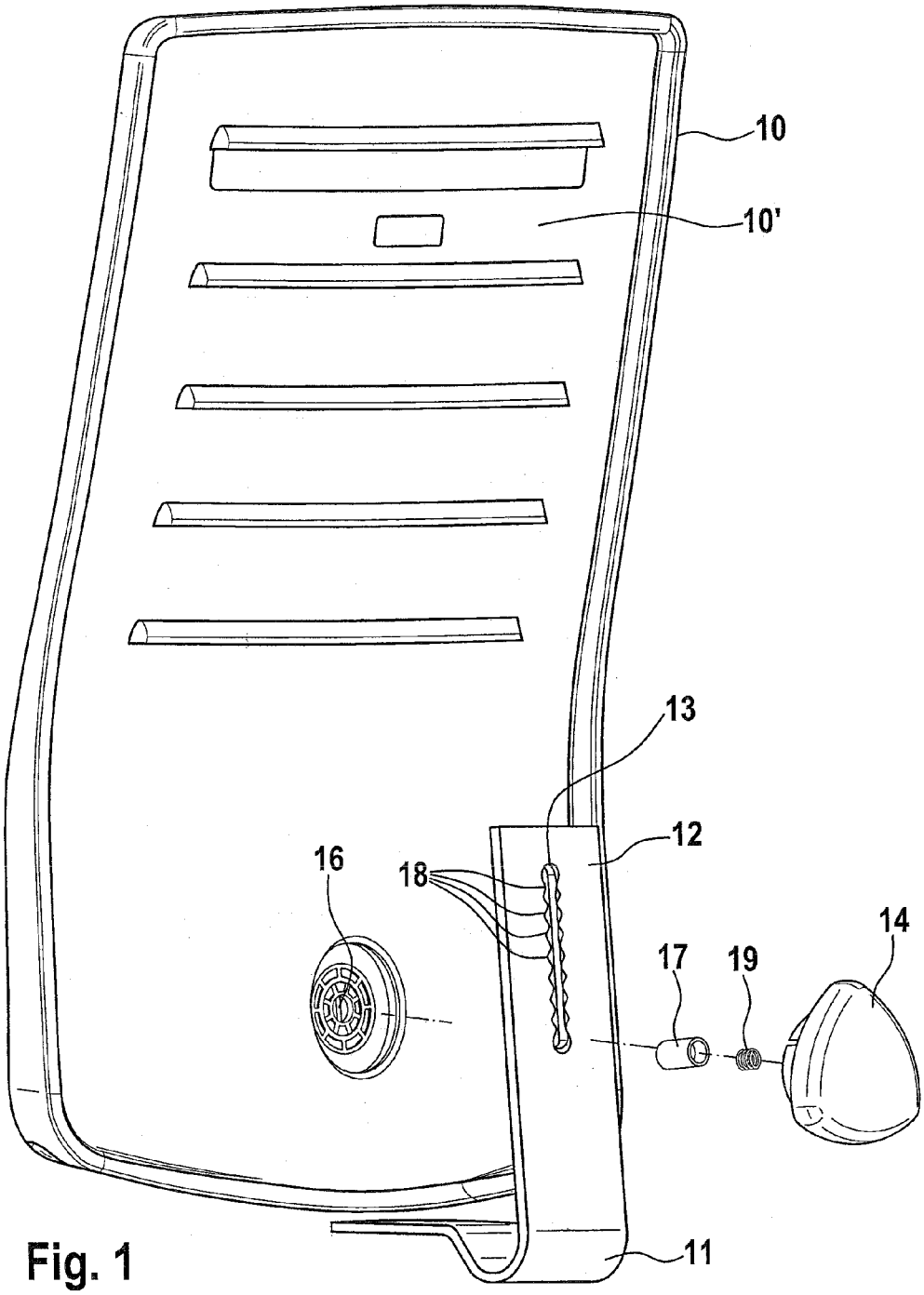
FIG. 1 is a schematic three-dimensional view of parts of an embodiment of the apparatus of the invention, with a backrest, securing element, clamping sleeve, compression spring, and handwheel.

In FIG. 1, the individual parts that are essential to the height adjusting mechanism of a backrest 10 in a chair according to the invention are shown in three dimensions on the order of an exploded view. An angled securing element 11 can be seen, whose horizontally extending lower portion is connected solidly to a chair body—not shown in the drawing. On its free end, the securing element 11 has a vertically upward-extending end portion 12 with a substantially vertically oriented oblong slot 13, through which a threaded bolt, not visible in FIG. 1 but connected on one end rigidly to a handwheel 14, reaches and is screwed on the other end into a thread 16 in the backrest 10, thereby fastening the backrest 10 to the end portion 12 of the securing element 11 in clamping fashion.

In the assembled state of the adjusting mechanism, however, the end portion 12 disappears visually between the backrest 10 and a rear covering element 10'.

Compared to known adjusting devices, the version according to the invention is distinguished in that, between the handwheel 14 and the end portion 12 of the securing element 11, a clamping sleeve 17 is provided, which has a through bore through which the threaded bolt reaches in the assembled state.

The clamping sleeve 17 has an end face, oriented toward the end portion 12 of the securing element 11, whose diameter in a direction perpendicular to the longitudinal axis of the clamping sleeve 17 is greater than the width of the oblong slot 13. Along the oblong slot 13 in the surface of the end portion 12 oriented toward the handwheel 14, a plurality of successive detent recesses 18 are provided that can be engaged in locking fashion by the end face of the clamping sleeve 17. The end face—not visible in FIG. 1—of the clamping sleeve 17 and the detent recesses 18 of the end portion 12 both have flat or curved oblique faces, which in the exemplary embodiment shown are spherical, in order to enable a form lock between the clamping sleeve 17 and the corresponding detent recess 18. Finally, a pressure-generating device is also provided, which in the installed state, with the threaded bolt screwed in, builds up a pressure force, between the handwheel 14 and the clamping sleeve 17, that extends parallel to the longitudinal axis of the clamping sleeve 17. In the exemplary embodiment shown, the pressure-generating device includes a compression spring 19.

Figure 2:
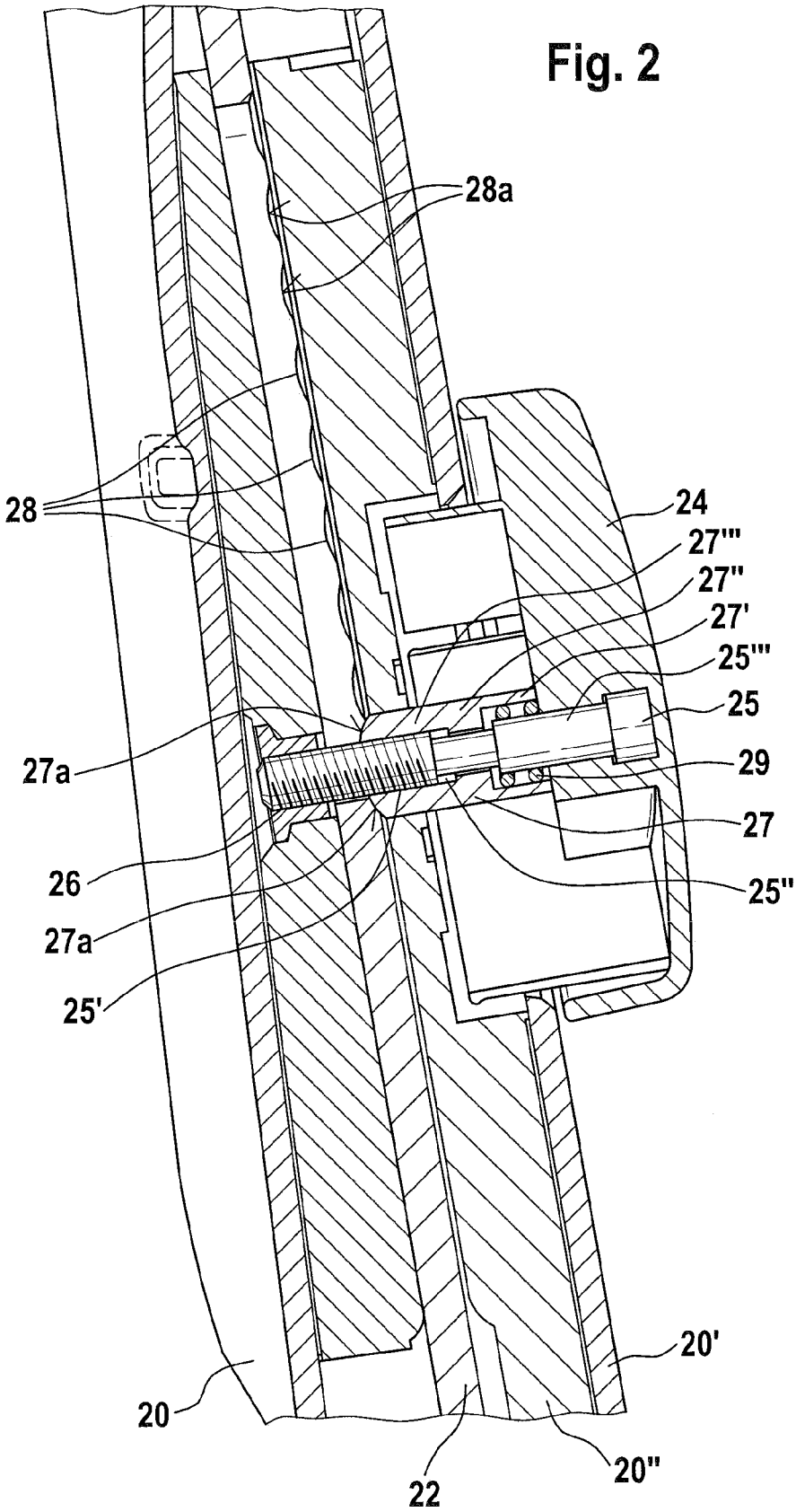
FIG. 2 is a schematic vertical section through an embodiment similar to that shown in FIG. 1, with the corresponding parts.

The function of the adjusting mechanism of the invention for adjusting the height of the backrest and/or the armrests, and the cooperation of the essential parts, can be seen especially well in the schematic vertical section of FIG. 2. This shows a detail of a backrest 20 with a back support 20" and with a covering element 20' (which furthermore need not necessarily be embodied as a separate part), and the vertical end portion 22 of a securing element; because of the sectional view shown, the oblong slot is indicated only by the absence of shading in this region. A handwheel 24 can also be seen, with a threaded bolt 25 firmly connected to it that penetrates a compression spring 29, a clamping sleeve 27, and one of a number of detent recesses 28 in the end portion 22 and is screwed into a thread 26 of the backrest 20. The thread 26 may also be embodied as a separate part, in the form of an inserted nut received in the back support 20".

The overall spherical shape of the oblique faces **27*a* at the end face of the clamping sleeve 27 and the spherical-shell-like oblique faces 28*a* on the detent recesses 28 of the end portion 22 are also readily seen in FIG. 2**.

The through bore in the clamping sleeve 27, on its end toward the handwheel 24 in the assembled state, has a first portion 27' with a bore diameter that is greater than or equal to the maximum outside diameter of the spring element, and adjoining it a second portion 27" with a bore diameter less than the outside diameter of the spring element. In the portion 27", a continuous thread fitting the thread of the threaded bolt 25 is provided. The portion 27" having the continuous thread is adjoined by a further portion 27'" without a thread, which extends as far as the end face toward the end portion 22 of the securing element, and which has a bore diameter that is only slightly greater than the maximum outside diameter of the threaded bolt 25.

Adjacent to its threaded portion 25', the threaded bolt 25 has a plunge cut 25'" with an outside diameter that is reduced compared to the thread. This is adjoined by a further portion 25'", whose outside diameter is greater than the inside diameter of the second portion 27" of the clamping sleeve 27 and smaller than the minimum inside diameter of the compression spring 29. As a result, on the one hand assurance is provided that in the installed state, the clamping sleeve 27 is held in captive fashion. On the other, a detent function with an easily opened handwheel 24 is thus obtained as well.

It will be understood that each of the elements described above, or two or more together, may also find a useful application in other types of constructions differing from the type described above.

While the invention has been illustrated and described as embodied in a chair, in particular an office chair, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A chair, comprising a chair body; a rest; an adjusting mechanism for adjusting a height of said rest in a direction of a vertical relative to said chair body, said adjusting mechanism including at least one securing element which is solidly connected to said chair body on one end of said adjusting mechanism and which has a free end with an end portion with a substantially vertically oriented slot, a threaded bolt extending through said slot and screwable into a thread in said rest, and a hand wheel to which said threaded bolt is rigidly connected, so that securing of said rest to said end portion of said securing element in clamping fashion is effected; a clamping sleeve located between said hand wheel and said end portion of said securing element and having a throughbore through which said threaded bolt reaches in an assembled state and an end face oriented toward said end portion of said securing element, and a diameter of said end face in a direction perpendicular to a longitudinal axis of said clamping sleeve is greater than a width of said slot; a plurality of successive detent elements provided along said slot in a surface of said end portion towards said hand wheel and lockingly engageable by said end face of said clamping sleeve, at least one element selected from the group consisting of said clamping sleeve and said detent recesses of said end portion having at least one oblique face; and a pressure-generating device which in the assembled state with said threaded bolt screwed in, builds up a pressure force between said hand wheel and said clamping sleeve and includes at least one force component parallel to said longitudinal axis of said clamping sleeve.

2. A chair as defined in claim 1, wherein said rest is a rest selected from the group consisting of a backrest, an arm rest, and both.

3. A chair as defined in claim 1, wherein said end portion of said securing element is an end portion selected from the group consisting of vertically and obliquely upwards-extending end portion.

4. A chair as defined in claim 1, wherein said slot of said end portion of said securing element is a slot selected from the group consisting of an oblong slot and a guide slot.

5. A chair as defined in claim 1, wherein said pressure generating device includes a spring element.

6. A chair as defined in claim 5, wherein said spring element includes an elastic portion.

7. A chair as defined in claim 6, wherein said elastic portion of said spring element is configured as a rubber buffer.

8. A chair as defined in claim 5, wherein said spring element includes a compression spring.

9. A chair as defined in claim 8, wherein said compression spring is configured as a helical spring.

10. A chair as defined in claim 8, wherein said threaded bolt in the assembled state reaches through said compression spring, and a maximum outside diameter of said threaded bolt is at most equal to a minimum outside diameter of said compression spring.

11. A chair as defined in claim 5, wherein said throughbore of said clamping sleeve on its end that in the assembled state is toward said hand wheel, has a first portion with a bore diameter at most equal to a maximum outside diameter of said spring element and adjoining it a second portion with a bore diameter less than the outside diameter of said spring element.

12. A chair as defined in claim 1, wherein said throughbore of said clamping sleeve, in a portion which in the assembled state does not directly adjoin said hand wheel, has a continuous thread fitting a thread of said threaded bolt.

13. A chair as defined in claim 12, wherein in said throughbore of said clamping sleeve, said portion having said continuous thread is adjoined by a further portion without a thread and extends as far as the end face toward said end portion of said securing element and has a bore diameter at most equal to a maximum outside diameter of said threaded bolt.

14. A chair as defined in claim 1, wherein said end face of said clamping sleeve has oblique faces, and detent recesses of said end portion of securing element have oblique faces, said oblique faces of at least one of said end face of said clamping sleeve and said securing element having spherical shapes.

15. A chair as defined in claim 1, wherein said end face of said clamping sleeve has oblique faces, and detent recesses of said end portion of securing element have oblique faces, said oblique faces of at least one of said end face of said clamping sleeve and said securing element having conical shapes.

16. A chair as defined in claim 1, wherein said end face of said clamping sleeve has oblique faces which are adapted geometrically to oblique faces provided on detent recesses in said end portion of said securing element in such a way that when an end face of said clamping sleeve snaps into a detent recess, a form lock is created.

17. A chair as defined in claim 1, wherein detent recesses in said end portion of said securing element adjoin one another directly.

18. A chair as defined in claim 1, wherein said clamping sleeve is composed from metal material.

19. A chair as defined in claim 1, wherein said securing element is configured as an angle securing element.

20. A chair as defined in claim 19, wherein said securing element includes an angled metal strip.

21. A chair as defined in claim 1, and further comprising a covering element provided between said hand wheel and said securing element and connected to said rest and also having a bore, through which in the assembled state said clamping sleeve reaches.

22. A chair as defined in claim 1, wherein said oblique face is a face selected from the group consisting of a flat oblique face and a curved oblique.

* * * * *